US006006054A

United States Patent [19]

Wong et al.

[11] Patent Number: 6,006,054

[45] **Date of Patent: *Dec. 21, 1999**

[54] METHOD OF ACHIEVING PURE TONE NOISE CONTROL IN A SYSTEM THAT EMITS PURE TONE NOISE

[75] Inventors: Chee-Chiu J. Wong, Fairport; Peter G. Fournia, Penfield, both of N.Y.

[73] Assignee: Xerox Corporation, Stamford, Conn.

[ * ] Notice: This patent is subject to a terminal disclaimer.

[21] Appl. No.: 09/213,793

[22] Filed: Dec. 17, 1998

[51] Int. Cl.[6] ..... G03G 15/02

[52] U.S. Cl. ..... 399/91; 250/324

[58] Field of Search ..... 399/91; 250/324, 250/325, 326

[56] References Cited

U.S. PATENT DOCUMENTS 4,908,006 3/1990 Burysek et al. ..... 474/117
4,908,007 3/1990 Henderson ..... 474/135
5,781,829 7/1998 Wong et al. ..... 399/91
5,784,670 7/1998 Sasahara et al. ..... 399/91

*Primary Examiner*—Fred L. Braun
*Attorney, Agent, or Firm*—William A. Henry; Philip E. Blair

[57] ABSTRACT

A method of achieving pure tone noise control in a charging system of a copier/printer. The method includes the steps of first providing a plurality of individual charging devices and providing a plurality of power supplies for charging the plurality of individual charging devices. Next, charging at least one of the plurality of individual charging devices with a first of the plurality of power supplies at a predetermined frequency and charging at least one of the plurality of individual charging devices with a second of the plurality of power supplies at a frequency different from, but within a band width of, the predetermined frequency; and, lastly, charging at least one of the plurality of individual charging devices with a third of the plurality of power supplies at a frequency different from that of the first and second power supplies and within the band width of the first power supply frequency.

8 Claims, 2 Drawing Sheets

METHOD OF ACHIEVING PURE TONE NOISE CONTROL IN A SYSTEM THAT EMITS PURE TONE NOISE

BACKGROUND OF THE INVENTION

This invention relates generally to the noise control in a copier or image output terminal (IOT), and more particularly concerns an improved noise control system utilizing an improved method and apparatus for providing optimum noise control in such apparatuses by masking the pure tones of charging devices.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image on image system in which the photoreceptive member is recharged, reimaged and developed for each color separation. This charging, imaging, developing and recharging reimaging and developing is usually done in a single revolution of the photoreceptor as compared with multipass architectures which allow image on image to be achieved with a single charge, recharge system and imager, etc. This architecture offers a high potential for throughput and image quality.

Charging and recharging IOT systems require a number of charging stations with attendant noise produced by those charging stations. Excessive noise from machines, such as, copier/printers in the working environment has been an irritant to others from the advent of such machines until the present day. One of the major contributors had been found to be the charging systems in the machines. Historically, noise from systems comes from the transformer and chock which can be controlled by an enclosure. However, in some systems noise is emitted from the wires of corona devices. Historically, noise from charging devices has been a problem, especially pure tone noise. In some copier/printers, modulation in charge frequency and amplitude creates beat, which makes the problem even more pronounced and complicated. Pure tone as used herein is noise at one or more discrete frequencies. A prior solution to this problem includes injecting white noise as background to mask the pure tone, but this will not only increase cost but also drive up the overall noise level of the machine which is undesirable. At 4 kHz, this is beyond the capability of active noise control. Another attempted solution is to control noise by absorption. However, pure tone is still audible. It is believed that all charging devices in some machines will be charged at about 4 kHz with the pure tone and beat from the charging devices causing operator discomfort. The pure tone at the operator position is about 60 dB. As machines speed up, the pure tone problem will become even more annoying.

The following disclosures may be relevant to various aspects of the present invention:

U.S. Pat. No. 4,908,006

Patentee: Buryseket al.

Issued: Mar. 13, 1990

U.S. Pat. No. 4,908,007

Patentee: Henderson

Issued: Mar. 13, 1990

The relevant portions of the foregoing disclosures may be briefly summarized as follows:

U.S. Pat. No. 4,908,006 discloses a belt tightening device for open-end spinning machines which is capable of ensuring good belt thrust, eliminating vibrations, and reducing the noise level of the machine. Each bearing box of a belt tightening roll is attached to the end of a pair of flat legs extending in spaced apart relationship to each other along the endless driving belt. The legs are connected to the bearing box either by sprint elements, or are formed themselves by leaf springs.

U.S. Pat. No. 4,908,007 is directed to a tensioner for a power transmission belt that is adapted to be operated in an endless path and a method of making the same. The tensioner includes a frictional dampening unit operatively associated with the belt tensioner to dampen the movement of a belt.

In accordance with one aspect of the present invention, there is provided a method of reducing noise from wires in a charging device. The method comprises masking pure tone noise of one charging device with that of another.

Pursuant to another aspect of the present invention, there is provided an apparatus that controls pure tone noise generated from multiple wire discorotrons. The apparatus includes a first power supply that charges one or more discorotrons at a frequency of 4 kHz. At this frequency, masking can be achieved within a band width of ±223 Hz. A second power supply that charges one or more discorotrons at a frequency of about 3897 Hz, and a third power supply that charges one or more discorotrons at a frequency of about 4076 Hz, such that the pure tone noise from each power supply will mask each other. Beat is eliminated by ensuring that the charge frequencies are over 40 Hz apart.

Other features of the present invention will become apparent as the following description proceeds and upon reference to the drawings, in which.

This invention relates to a noise reduction scheme for an imaging system of the type which is used to produce an image on image color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including use in a multiple pass image on image color process system, and a single or multiple pass highlight color system.

Additionally, this invention relates to corona devices in general. Corona devices are devices that ionize air for purposes of delivering ions to surfaces to be charged. It contains an element called a coronode that stimulates ionization of the air. Examples of corona devices are corotrons, scorotrons, dicorotrons, discorotrons and pin corotrons. Examples of a coronode are thin wire, pins, and dielectric coated wire. Power supplies are used to supply energy to the corona devices with an individual power supply energizing multiple corona devices.

Figure 1:
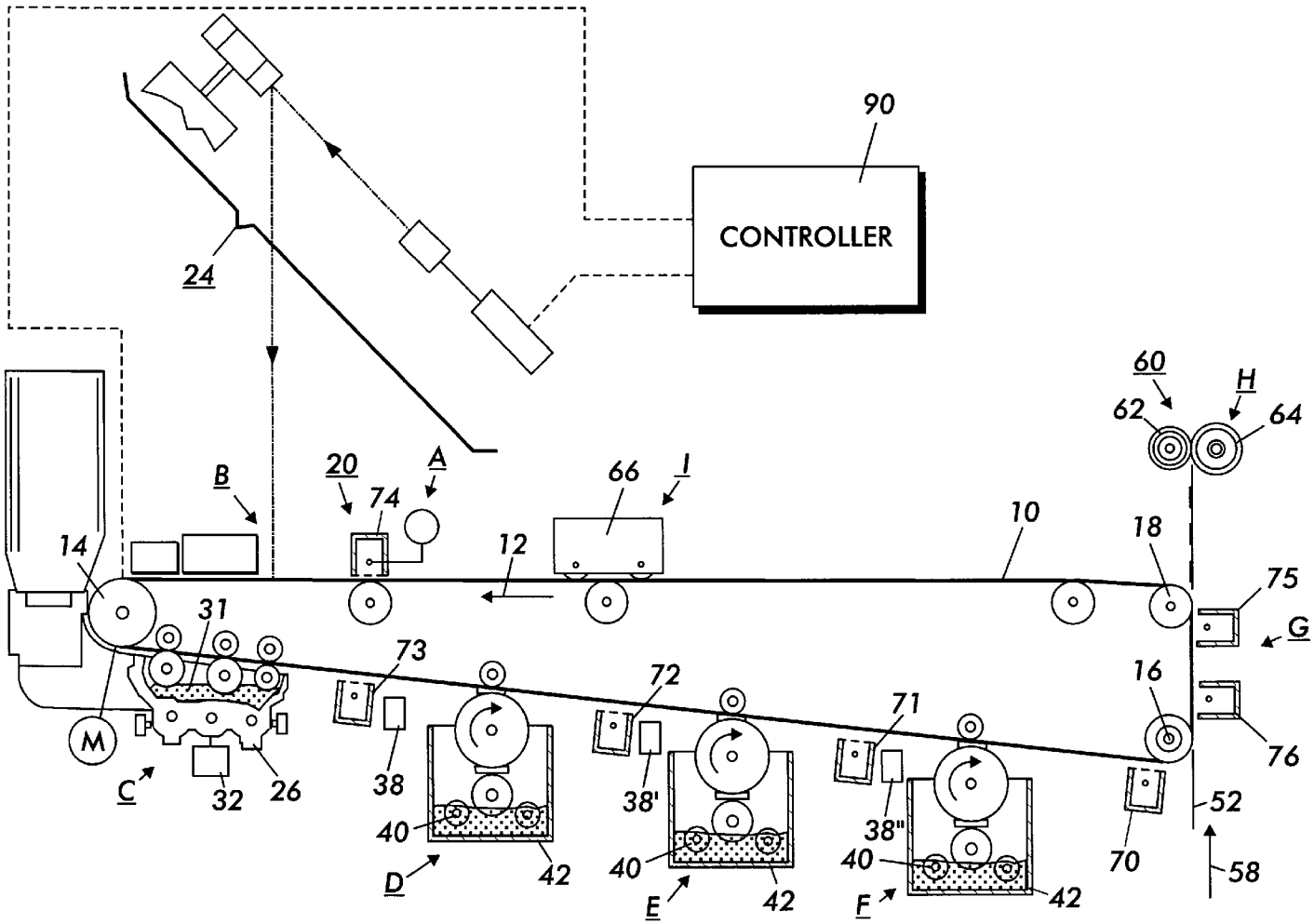
FIG. 1 is a schematic diagram of a four color image output terminal utilizing the discorotron noise reduction apparatus and method of the present invention.

Turning now to FIG. 1, an electrophotographic printing machine is shown that employs the pure tone noise control apparatus and method of the present invention and uses a charge retentive surface in the form of an Active Matrix (AMAT) photoreceptor belt 10 supported for movement in the direction indicated by arrow 12, for advancing sequentially through the various xerographic process stations and controlled by a controller 90. The belt is entrained about a drive roller 14 and two tension rollers 16 and 18 and the roller 14 is operatively connected to a drive motor M for effecting movement of the belt through the xerographic stations.

With continued reference to FIG. 1, a portion of belt 10 passes through charging station A where a corona generating device, indicated generally by the reference numeral 20, charges the photoconductive surface of belt 10 to a relative high, substantially uniform, preferably negative potential.

Next, the charged portion of photoconductive surface is advanced through an imaging station B. At imaging exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{background}$ equal to about −50 volts. Thus after exposure, the photoreceptor contains a monopolar voltage profile of high and low voltages, the former corresponding to charged areas and the latter corresponding to discharged or background areas.

At a first development station C, a magnetic brush developer structure, indicated generally by the reference numeral 26 advances insulative magnetic brush (IMB) material 31 into contact with the electrostatic latent image. The development structure 26 comprises a plurality of magnetic brush roller members. These magnetic brush rollers present, for example, charged black toner material to the image areas for development thereof. Appropriate developer biasing is accomplished via power supply 32.

A corona recharge device having a high output current vs. control surface voltage (I/V) characteristic slope is employed for raising the voltage level of both the toned and untoned areas on the photoreceptor to a uniform predetermined level.

A second exposure or imaging device 38 which may comprise a laser based input and/or output structure is utilized for selectively discharging the photoreceptor on toned areas and/or bare areas, pursuant to the image to be developed with a second color developer. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by a magnetic brush developer roller. A power supply (not shown) serves to electrically bias the developer structure to a level effective to develop the DAD image areas with negatively charged yellow toner particles 40.

The above procedure is repeated for a third imager for a third suitable color toner such as magenta and for a fourth imager and suitable color toner such as cyan. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer discorotron member 70 is provided to precondition the toner for effective transfer to a substrate using positive corona discharge.

Subsequent to pretransfer a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed roll rotates so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station G.

Transfer station G includes a transfer dicorotron 76 which sprays positive ions onto the backside of sheet 52. This attracts the negatively charged toner powder images from the belt 10 to sheet 52. A detack corona device 75 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

Figure 2A:
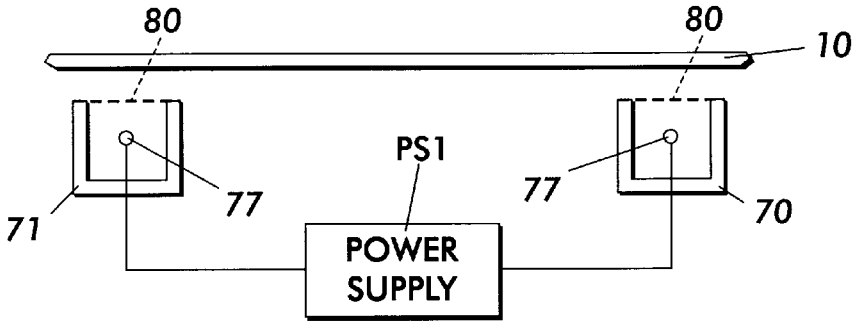
FIGS. 2A–2C are schematic diagrams of the corona devices and power supplies in accordance with the present invention.
Figure 2B:
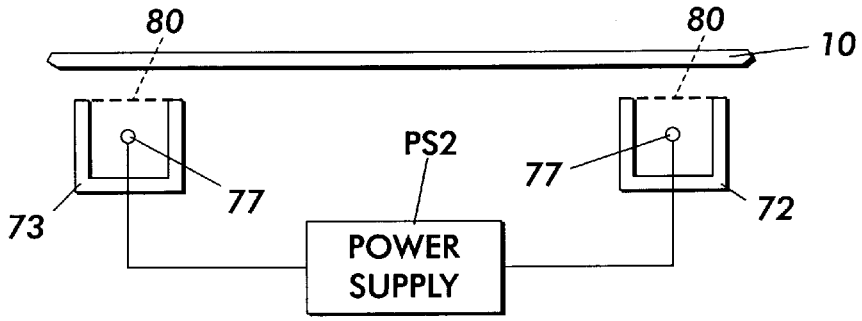
Figure 2C:
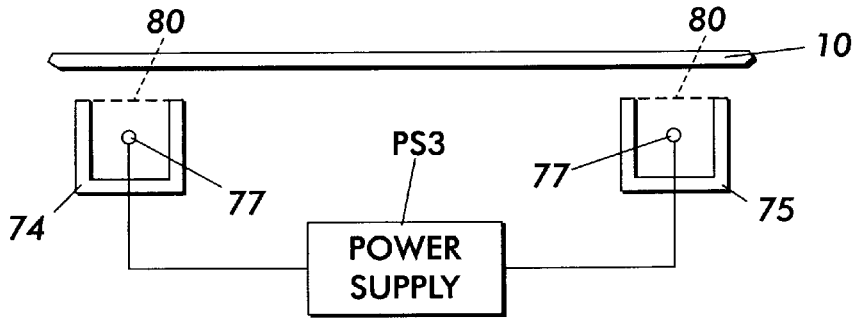

In FIGS. 2A–2C, a method and apparatus is shown that reduce the impact of a pure auditory tone, such as that generated by a discorotron on a copier or printer operator by spreading the tones at nearby frequencies. If the frequencies are chosen correctly, the operator annoyance due to audible noise is reduced. As shown in FIGS. 2A–2C, a pure tone noise control method and apparatus is utilized that masks the pure tone of one charging device by using the pure tone of another. This should not be confused with 180° out of phase cancellation, but rather is obtained by means of psychoacoustic phenomena as discussed in "Auditory Masking" by S. Buus, in the "Encyclopedia of Acoustics", edited by M. J. Crocker, Wiley-Interscience, New York, 1997, and in "Acoustics Measurement if Airborne Noise Emitted by Computer and Business Equipment", International Standard ISO 7779, International Organization of Standardization, Geneva, Switzerland, 1988.

In general, the width of critical band, $\Delta f_c$, centered at any frequency, f, is given by the following equations:

$$\Delta f_c = 25 + 75\,[1 + 1.4(f/1{,}000)^2]^{0.069} \quad (1)$$

For a given center frequency, the upper and lower frequency ($f_2$ and $f_1$) can be determined by the following:

$$f_2, f_1 = f \pm \Delta f_c/2 \quad (2)$$

In FIG. 2A, a power supply PS1 is connected to discorotrons 70 and 71 that are conventionally supported closely adjacent to photoreceptor 10. Discorotron is used herein to mean a dielectric coated coronode wire with a charge leveling screen located a predetermined distance from the coronode wire. Discorotrons 70 and 71 include coronode wires 77 and charge leveling screens 80. A power supply PS1 is connected to both coronodes and adapted to energize or charge them at 4 kHz. At this frequency, the critical band width is ±223 Hz that is calculated by using equations (1) and (2).

Corona devices 72, 73, 74 and 75 have coronodes and screens similar to those of discorotrons 70 and 71, but have power supplies that charge them at different frequencies. Here, in accordance with the present invention, power supply PS2 charges coronodes 77 of corona devices 72 and 73 at 3897 Hz and power supply PS3 is selected to charge coronodes 77 of corona devices 74 and 75 at a frequency of 4076 Hz. Consequently the charging frequencies of all three power supplies are within the critical bandwidth of each other. The pure tone from each power supply will mask each other. It is critical that the charge frequencies are over 40 Hz apart in order to eliminate beat.

It should therefore now be understood that a method and apparatus has been disclosed for controlling annoying pure tone noise by masking the pure tone of one device with that of another. The acoustic signature of a second device is designed to emit a broad band noise or pure tone noise within the critical band of that of a first device, thus, the pure tone from the first device will be masked. While the present invention is disclosed with reference to controlling pure tone noise of discorotrons in a copier/printer, it is contemplated that the method of the present invention can be applied to control of pure tone from motor noise, fan and blower noise, automatic tire noise, etc.

It is, therefore, apparent that there has been provided in accordance with the present invention, a method and apparatus for noise reduction of scorotron or corotron wires in a copier/printer that fully satisfies the aims and advantages hereinbefore set forth. While the invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of achieving pure tone noise control in a charging system of a copier/printer, comprising the steps of:

providing a plurality of individual charging devices;

providing a plurality of power supplies for charging said plurality of individual charging devices;

charging at least one of said plurality of individual charging devices with a first of said plurality of power supplies at a predetermined frequency;

charging at least one of said plurality of individual charging devices with a second of said plurality of power supplies at a frequency different from, but within a band width of, said predetermined frequency; and charging at least one of said plurality of individual charging devices with a third of said plurality of power supplies at a frequency different from that of said first and second power supplies and within said band width of said first power supply frequency.

2. The method of claim 1, including the step of providing discorotrons as said charging devices.

3. The method of claim 1, including the step of providing corotrons as said charging devices.

4. The method of claim 1, including the step of providing dicorotrons as said charging devices.

5. A method of achieving pure tone noise control in a charging system of a copier/printer, comprising the steps of:

providing a plurality of individual charging devices;

providing a plurality of power supplies for charging said plurality of individual charging devices;

charging at least one of said plurality of individual charging devices with a first of said plurality of power supplies at a predetermined frequency and band width; and charging another of said plurality of individual charging devices with another of said plurality of power supplies at a frequency different from that of said first of said plurality of power supplies and within said band width of said first power supply frequency.

6. The method of claim 5, including the step of providing discorotrons as said charging devices.

7. The method of claim 5, including the step of providing corotrons as said charging devices.

8. The method of claim 5, including the step of providing dicorotrons as said charging devices.

* * * * *